US007393072B2

(12) United States Patent
Lim et al.

(10) Patent No.: US 7,393,072 B2
(45) Date of Patent: Jul. 1, 2008

(54) METHOD OF DRIVING AN INK-JET PRINTHEAD

(75) Inventors: Seong-taek Lim, Suwon-si (KR); Jae-woo Chung, Suwon-si (KR); Jong-beom Kim, Yongin-si (KR); Kwang-ho Lee, Seoul (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 431 days.

(21) Appl. No.: 11/052,285

(22) Filed: Feb. 8, 2005

(65) Prior Publication Data

US 2005/0190220 A1 Sep. 1, 2005

(30) Foreign Application Priority Data

Feb. 27, 2004 (KR) ..... 10-2004-0013643

(51) Int. Cl.
*B41J 29/38* (2006.01)
*B41J 2/045* (2006.01)
*B41J 2/05* (2006.01)

(52) U.S. Cl. ..... 347/10; 347/11; 347/68; 347/70; 347/57

(58) Field of Classification Search ..... 347/10, 347/11, 57, 68, 70, 69, 71, 72
See application file for complete search history.

(56) References Cited

U.S. PATENT DOCUMENTS 5,689,291 A 11/1997 Tence et al.
6,029,896 A 2/2000 Self et al.
6,241,345 B1 * 6/2001 Ushioda ..... 347/68
6,290,315 B1 9/2001 Sayama ..... 347/10
6,331,040 B1 12/2001 Yonekubo et al. ..... 347/15
6,886,898 B2 * 5/2005 Kojoh et al. ..... 347/10
6,962,398 B2 * 11/2005 Okuda et al. ..... 347/10
7,150,517 B2 * 12/2006 Satake ..... 347/68

FOREIGN PATENT DOCUMENTS

JP 59-042965 3/1984
WO WO 02/26499 4/2002

* cited by examiner

*Primary Examiner*—Stephen D. Meier
*Assistant Examiner*—Rene Garcia, Jr.
(74) *Attorney, Agent, or Firm*—Lee & Morse, P.C.

(57) ABSTRACT

A method of driving an ink-jet printhead, the ink-jet printhead having a pressure chamber to be filled with ink, a piezoelectric actuator for varying a volume of the pressure chamber, and a nozzle, through which an ink droplet is ejected, connected to the pressure chamber, the method including applying a driving pulse to the piezoelectric actuator to change the volume of the pressure chamber, thereby ejecting the ink droplet through the nozzle due to a change in pressure in the pressure chamber caused by the change in volume of the pressure chamber, and changing a volume of the ink droplet ejected through the nozzle by maintaining a rising time of the driving pulse constant and adjusting a duration time of a maximum voltage of the driving pulse.

9 Claims, 6 Drawing Sheets

METHOD OF DRIVING AN INK-JET PRINTHEAD

BACKGROUND OF THE INVENTION

1. Field of the Invention

The present invention relates to a method of driving an ink-jet printhead. More particularly, the present invention relates to a method of driving an ink-jet printhead using a driving waveform capable of representing gradation.

2. Description of the Related Art

In general, ink-jet printheads eject fine droplets of ink for printing at desired positions on a recording medium to print an image of a predetermined color. Ink-jet printheads may be classified into two types according to a mechanism used to eject an ink droplet. A first type is a bubble jet type ink-jet printhead, which generates a bubble in ink using a heat source to eject an ink droplet by an expansion force of the bubble. A second type is a piezoelectric type ink-jet printhead, which ejects an ink droplet by pressure applied to ink due to a deformation of a piezoelectric body.

FIG. 1 illustrates a structure of a conventional piezoelectric type ink-jet printhead.

Referring to FIG. 1, an ink-jet printhead 10 includes a pressure chamber 15 filled with ink to be ejected. Ink supply paths 28 and 34, through which ink is supplied from an ink reservoir 35 to a pressure chamber 15, are connected to one side of the pressure chamber 15. Ink discharge paths 29 and 36 are connected to the other side of the pressure chamber 15. A nozzle 13 for ejecting the ink is formed at an end portion of the ink discharge paths 29 and 36. A vibration plate 23 is provided in an upper portion of the pressure chamber 15. A piezoelectric actuator 25 for providing a driving force to eject the ink by vibrating the vibration plate 23, which changes a volume of the pressure chamber 15, is provided on the vibration plate 23. The piezoelectric actuator 25 includes a common electrode 26 formed on the vibration plate 23, a piezoelectric film 14 formed of a piezoelectric material on the common electrode 26, and a driving electrode 27 formed on the piezoelectric film 14 for applying a driving voltage to the piezoelectric film 14.

In such a piezoelectric type ink-jet printhead 10, when a driving pulse having a predetermined driving voltage is applied to the piezoelectric film 14 through the driving electrode 27, the vibration plate 23 is bent by the deformation of the piezoelectric film 14, thereby decreasing the volume of the pressure chamber 15. As the volume of the pressure chamber 15 decreases, the pressure in the pressure chamber 15 increases. This increase in pressure in the pressure chamber 15 causes the ink in the pressure chamber 15 to be ejected out of the printhead 10 through the nozzle 13. Then, when the driving pulse applied to the piezoelectric film 14 is removed, the vibration plate 23 is restored to an original shape thereof and the volume of the pressure chamber 15 increases. As the volume in the pressure chamber 15 increases, the pressure in the pressure chamber 15 decreases. This decrease in pressure causes ink to be absorbed from the ink reservoir 35 through the ink supply paths 34 and 28, thereby refilling the pressure chamber 15 with ink.

The above-described piezoelectric type ink-jet printhead is advantageous in representing gradation because it can eject ink droplets having a variety of volumes through the nozzle 13, which has a uniform diameter, depending on the waveform of the driving pulse applied to the piezoelectric actuator 25.

FIG. 2 illustrates driving waveforms for use in a conventional method of driving the ink-jet printhead shown in FIG. 1.

The driving pulses shown in FIG. 2 have waveforms to adjust a volume of a droplet in two steps. More specifically, a first driving pulse to eject a droplet having a relatively smaller volume includes a first pulse and a second pulse. A second driving pulse to eject a droplet having a relatively larger volume includes only a second pulse. The second pulse is a main pulse providing a driving force sufficient to eject an ink droplet, while the first pulse is an auxiliary pulse that is not sufficient to cause ejection of an ink droplet.

When the first pulse is initially applied to the piezoelectric actuator 25, prior to application of the second pulse, the vibration plate 23 vibrates slightly due to the first pulse before the droplet is ejected and the meniscus of the ink in the nozzle 13 retreats. When the second pulse for ejecting the droplet is applied at the point when the meniscus of the ink retreats, the volume of the droplet is reduced. Accordingly, a diameter of a dot printed on the recording medium decreases. When the second driving pulse having only the second pulse is applied to the piezoelectric actuator 25, a droplet having a relatively larger volume is ejected. Accordingly, the diameter of a dot printed on the recording medium increases.

However, in the above driving method, accurately adjusting a timing of the retreat of the meniscus of the ink is difficult. The speed when a smaller droplet is ejected is slower than that when a larger droplet is ejected. Accordingly, a position of the dot on the recording medium is changed, which deteriorates print quality.

FIG. 3 illustrates driving waveforms used in another conventional method of driving an ink-jet printhead.

According to the driving waveforms shown in FIG. 3, by selectively applying a first pulse to eject a droplet having a small volume and a second pulse to eject a droplet having a large volume, droplets having three different volumes can be ejected. More specifically, when a first driving pulse including only the first pulse is applied to the piezoelectric actuator 25, a droplet having a small volume is ejected and a dot having a small diameter is printed on the recording medium. Although not shown, when only the second pulse is applied to the piezoelectric actuator 25, a droplet having a large volume is ejected and a dot having a large diameter is printed on the recording medium. When a second driving pulse including both the first and second pulses is applied to the piezoelectric actuator 25, a droplet having a small volume is initially ejected and a droplet having a large volume is ejected to overlap the droplet having the small volume, which prints a dot having the largest diameter on the recording medium.

According to the above driving method, although there is a difference in the ejection speed of the droplet having a relatively larger volume and that of the droplet having a relatively smaller volume, since the slow speed of the droplet having a smaller volume can be compensated for by applying the first pulse to eject the smaller droplet prior to the second pulse to eject the larger droplet, the two droplets can be located at the same position on the recording medium.

However, in the above conventional driving method, ejection timing control is difficult with respect to two droplets having different ejection speeds. Furthermore, when two droplets are overlapped to print a dot having the largest diameter on the recording medium, it is difficult for the printed dot to have a perfect circle and the diameter of the dot is not proportional to the volumes of the ejected droplet.

SUMMARY OF THE INVENTION

The present invention is therefore directed to a method of driving an ink-jet printhead, which substantially overcomes one or more of the problems due to the limitations and disadvantages of the related art.

It is a feature of an embodiment of the present invention to provide a method of driving an ink-jet printhead that is capable of adjusting a volume of an ejected ink droplet for the representation of gradation while reducing a change in an ejection speed of the droplet.

It is another feature of an embodiment of the present invention to provide a method of driving an ink-jet printhead that is capable of changing a volume of an ejected ink droplet while constantly maintaining an ejection speed of the ink droplet even at a high driving frequency.

At least one of the above and other features and advantages of the present invention may be realized by providing a method of driving an ink-jet printhead, the ink-jet printhead having a pressure chamber to be filled with ink, a piezoelectric actuator for varying a volume of the pressure chamber, and a nozzle, through which an ink droplet is ejected, connected to the pressure chamber, the method including applying a driving pulse to the piezoelectric actuator to change the volume of the pressure chamber, thereby ejecting the ink droplet through the nozzle due to a change in pressure in the pressure chamber caused by the change in volume of the pressure chamber, and changing a volume of the ink droplet ejected through the nozzle by maintaining a rising time of the driving pulse constant and adjusting a duration time of a maximum voltage of the driving pulse.

Changing the volume of the ink droplet ejected through the nozzle may include increasing the duration time of the maximum voltage of the driving pulse to increase the volume of the ink droplet ejected through the nozzle.

The method may further include terminating the duration time of the maximum voltage of the driving pulse before a maximum displacement of the piezoelectric actuator is reached.

Changing the volume of the ink droplet ejected through the nozzle may include varying the duration time of the maximum voltage of the driving pulse within a range of about three (3) μs to about nine (9) μs.

The method may further include maintaining a falling time of the driving pulse constant.

Changing the volume of the ink droplet ejected through the nozzle may include varying the volume of the ejected ink droplet from about 20 pl to about 50 pl.

Changing the volume of the ink droplet ejected through the nozzle may include varying the maximum voltage of the driving pulse in addition to adjusting the duration time of the maximum voltage of the driving pulse. Varying the maximum voltage of the driving pulse and adjusting the duration time of the maximum voltage of the driving pulse may include decreasing the maximum voltage of the driving pulse as a driving frequency of the ink-jet printhead increases.

BRIEF DESCRIPTION OF THE DRAWINGS

The above and other features and advantages of the present invention will become more apparent to those of ordinary skill in the art by describing in detail exemplary embodiments thereof with reference to the attached drawings in which.

DETAILED DESCRIPTION OF THE INVENTION

Figure 1:
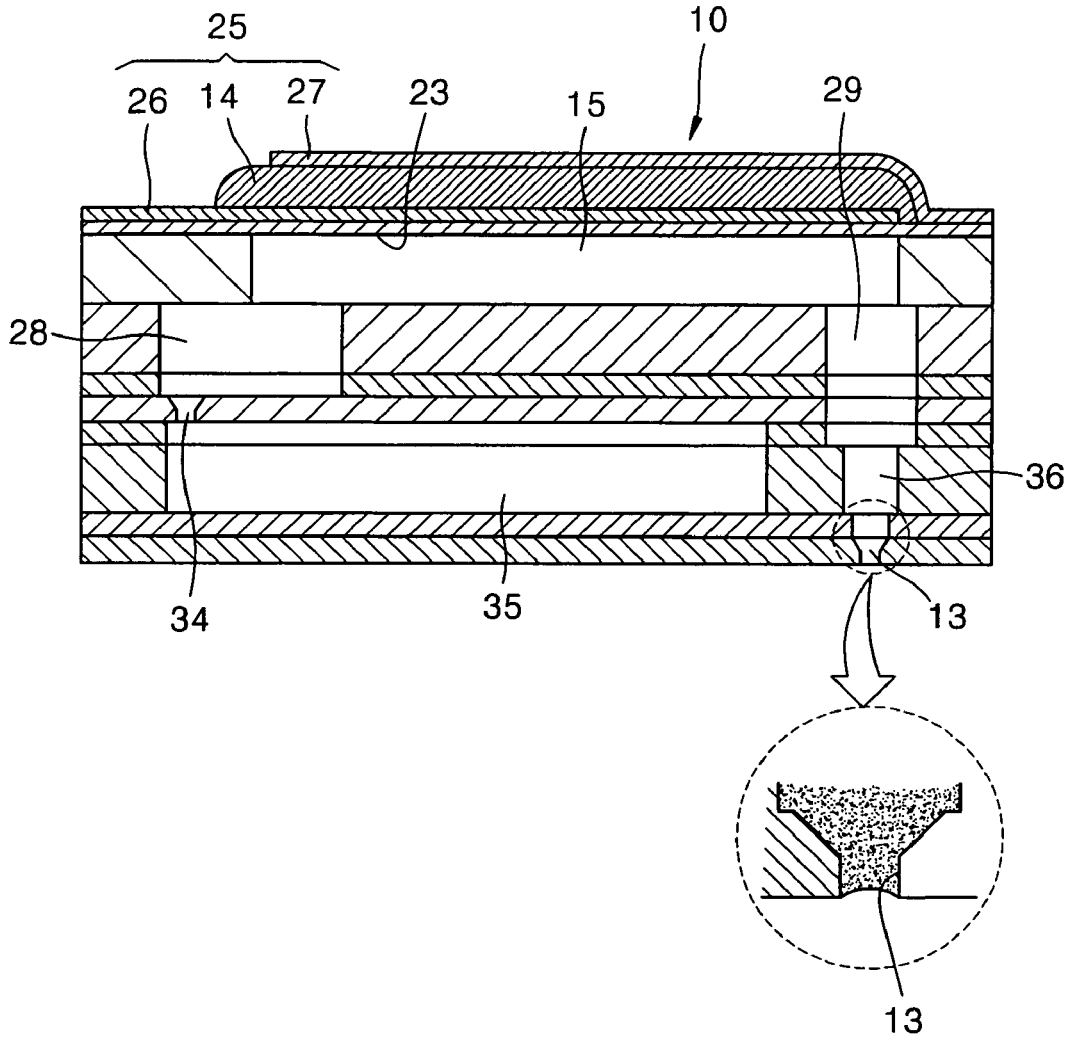
FIG. 1 (PRIOR ART)
FIG. 1 illustrates a cross-sectional view of a conventional piezoelectric type ink-jet printhead.
Figure 2:
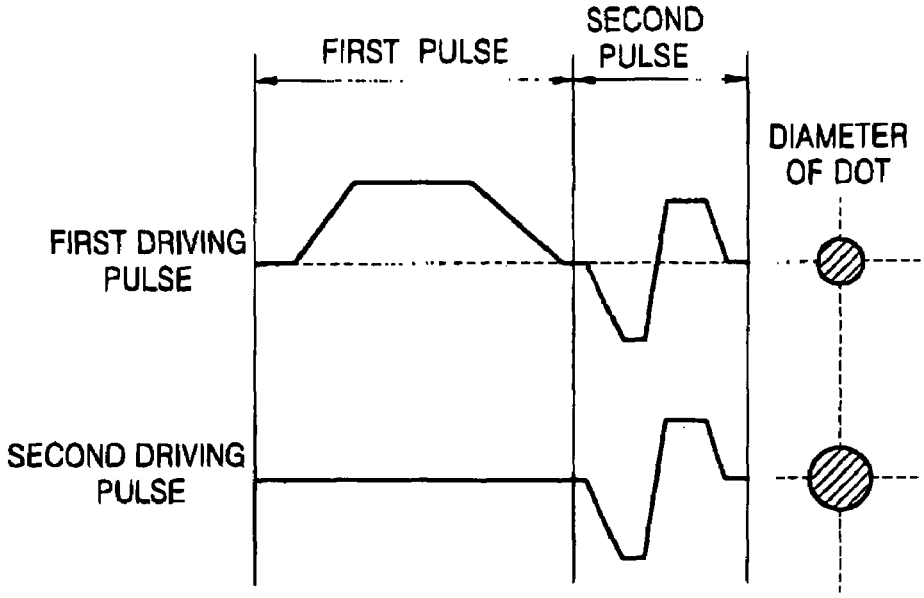
FIG. 2 (PRIOR ART)
FIG. 2 illustrates first conventional driving waveforms used to drive a conventional printhead.
Figure 3:
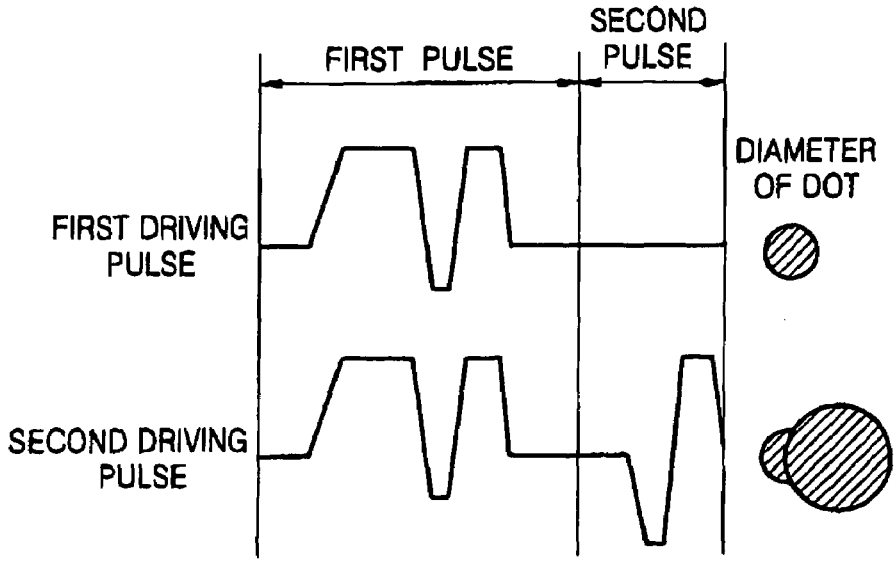
FIG. 3 (PRIOR ART)
FIG. 3 illustrates second conventional driving waveforms used to drive a conventional printhead.

Korean Patent Application No. 10-2004-0013643, filed on Feb. 27, 2004, in the Korean Intellectual Property Office, and entitled: "Method of Driving Ink-jet Printhead," is incorporated by reference herein in its entirety.

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

Figure 4:
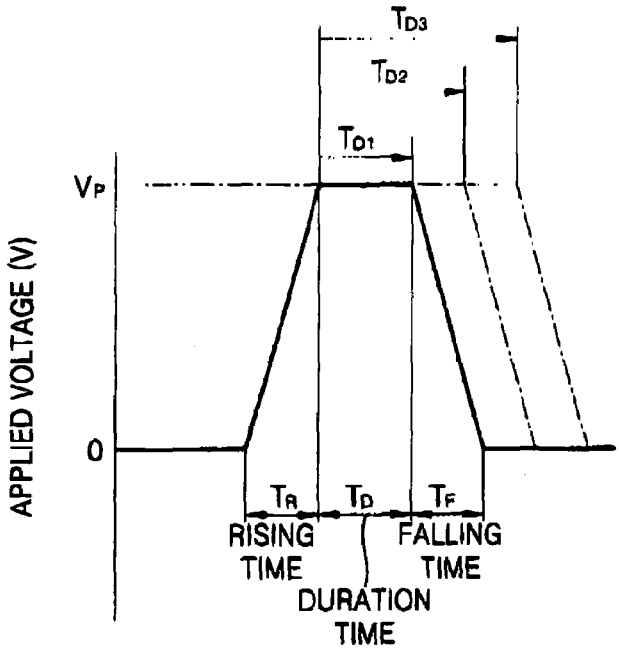
FIG. 4 illustrates a waveform of a driving pulse used in a method of driving an ink-jet printhead according to a first embodiment of the present invention.

Referring to FIG. 4, in a method of driving an ink-jet printhead according to a first embodiment of the present invention, a driving pulse applied to a piezoelectric actuator for ejecting an ink droplet is a trapezoidal waveform. An overall time of the driving pulse having the trapezoidal waveform consists of a rising time $T_R$, during which time a voltage increases, a duration time $T_D$, during which time the maximum voltage $V_P$, i.e., a driving voltage, is constantly maintained, and a falling time $T_F$, during which time the voltage decreases.

In the first embodiment of the present invention, by maintaining the rising time $T_R$ of the driving pulse constant and adjusting the duration time $T_D$ of the maximum voltage $V_P$, a volume of a droplet ejected through a nozzle may be adjusted. Accordingly, the volume of the droplet ejected through the nozzle can be varied according to the adjustment of the duration time $T_D$ of the maximum voltage $V_P$. Simultaneously, an ejection speed of the droplet may be maintained relatively constant by constantly maintaining the rising time $T_R$. The falling time $T_F$ of the driving pulse may also be constantly maintained.

More specifically, when a driving pulse is applied to the piezoelectric actuator in a state in which a pressure chamber is filled with ink, a displacement response of a vibration plate deformed by the piezoelectric actuator is determined by several factors. These factors include structural strength of the piezoelectric actuator, damping by viscosity of the ink, and inertia of the entire system including the piezoelectric actuator and the ink in an ink path. Typically, when a driving pulse having a waveform by which the maximum voltage $V_P$ is reached by the rising time $T_R$, e.g., one (1) μs, is applied to the piezoelectric actuator, the maximum displacement of the vibration plate is obtained after several μs, i.e., several times the rising time $T_R$, due to a delay in response influenced by the inertia and the viscosity. Accordingly, when the duration time $T_D$ of the maximum voltage $V_P$ is terminated before a maximum displacement of the vibration plate is reached, the voltage is reduced to 0 V and the amount of the maximum displacement of the vibration plate increases in proportion to the duration time $T_D$ of the maximum voltage $V_P$. Thus, when the duration time $T_D$ of the maximum voltage $V_P$ of the driving pulse is increased from $T_{D1}$ to $T_{D2}$ or to $T_{D3}$, the volume of the ejected droplet similarly increases.

The ejection speed of the droplet is influenced by the speed of the displacement of the vibration plate rather than by the maximum displacement amount. The speed of the displacement of the vibration plate increases as the rising time $T_R$ decreases. Thus, when the rising time $T_R$ is constantly maintained, even when the volume of the ejected droplet changes, the ejection speed of the droplet is maintained substantially constant.

As a result, according to an embodiment of the present invention, adjustment of the volume of the droplet for representing gradation is facilitated and, since the positions of dots printed on a recording medium are uniform, superior print quality may be obtained.

Figure 5:
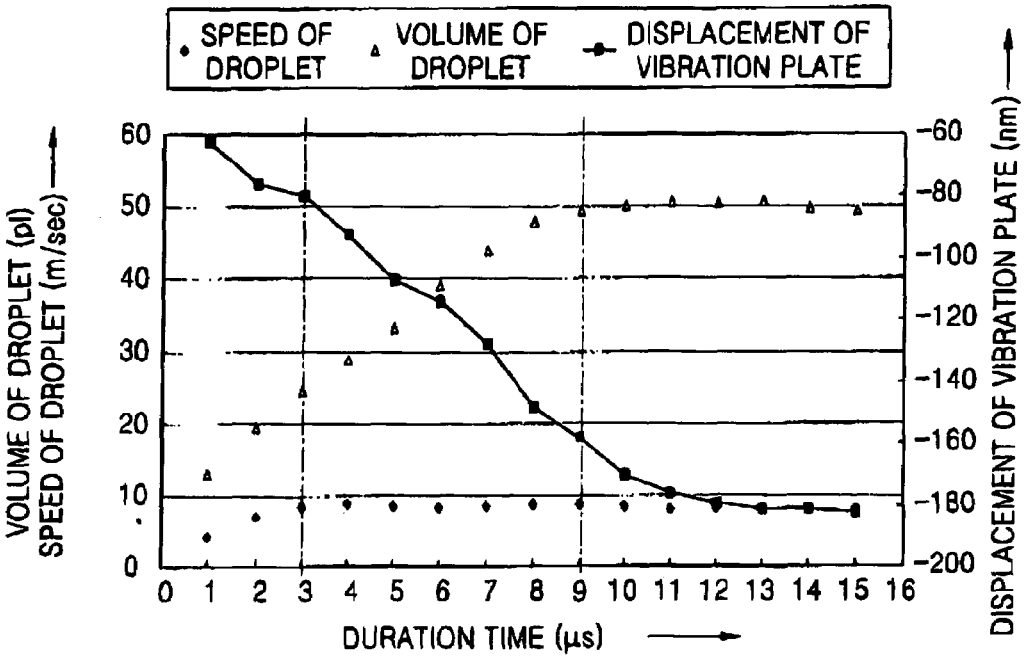
FIGS. 5 and 6 are graphs showing results of tests on ink droplet ejection performance of a printhead driven according to the method of FIG. 4.
Figure 6:
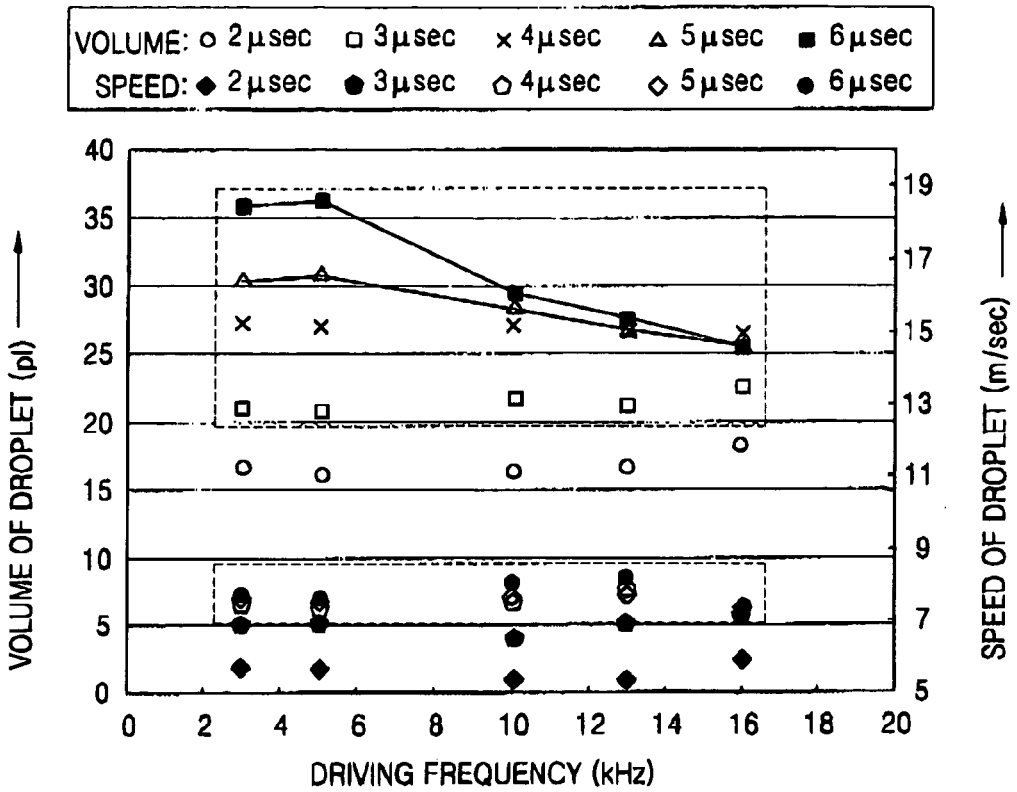

FIGS. 5 and 6 are graphs showing results of tests on ink droplet ejection performance of a printhead driven according to the method of FIG. 4.

Initially, the graph of FIG. 5 shows results of a measurement of displacement of the vibration plate, the volume of the ejected ink droplet, and the ejection speed of the ink droplet when the rising time $T_R$ and the falling time $T_F$ of the driving pulse applied to the piezoelectric actuator are fixed to one (1) μs and the duration time $T_D$ of the maximum voltage $V_P$ is increased in increments of one (1) μs.

As the duration time $T_D$ of the maximum voltage $V_P$ of the driving pulse increases, it may be seen that the displacement of the vibration plate increases gradually and the maximum displacement of the vibration plate is substantially reached when the duration time $T_D$ is about twelve (12) μs. Also, the volume of the droplet gradually increases as the duration time $T_D$ increases. In particular, the volume of the droplet increases almost proportionally to the duration time $T_D$, until the duration time $T_D$ reaches about nine (9) μs.

Further, it may be seen that the speed of the droplet is substantially unchanged, even when the duration time $T_D$ changes and the volume of the droplet increases. In particular, the ejection speed of the droplet is maintained almost constant when the duration time $T_D$ is about three (3) μs or greater.

To summarize the above results, it may be seen that, while the speed of the ejection of the droplet is maintained almost constant, the volume of the droplet can be almost proportionally increased by adjusting the duration time $T_D$ of the maximum voltage $V_P$ of the driving pulse within a range of about three (3) to about nine (9) μs. Moreover, the volume of the droplet may be adjusted very effectively within a range of about 20 to about 50 pl.

The graph of FIG. 6 shows results of a measurement of volume of the ejected ink droplet and the ejection speed of the ink droplet when the driving frequency is changed, i.e., when the rising time $T_R$ and the falling time $T_F$ of the driving pulse applied to the piezoelectric actuator are fixed to one (1) μs and the duration time $T_D$ of the maximum voltage $V_P$ is increased from two (2) μs to six (6) μs in increments of one (1) μs.

In the graph of FIG. 6, it may be seen that the results are similar to those in the graph of FIG. 5 at lower driving frequencies. For example, the ejection speed of the droplet is maintained almost constant even when the driving frequency is increased and the volume of the droplet is uniformly maintained until a volume of 25 pl is reached. However, when a droplet having a volume greater than 25 pl, e.g., 30 pl, is ejected, a phenomenon occurs in which the volume of the droplet decreases as the driving frequency increases for the same duration time $T_D$ of the maximum voltage $V_P$. Thus, the volume of the ink droplet cannot be efficiently changed by adjusting only the duration time $T_D$ of the maximum voltage $V_P$ at a relatively high driving frequency, e.g., ten (10) kHz or more.

Figure 7A:
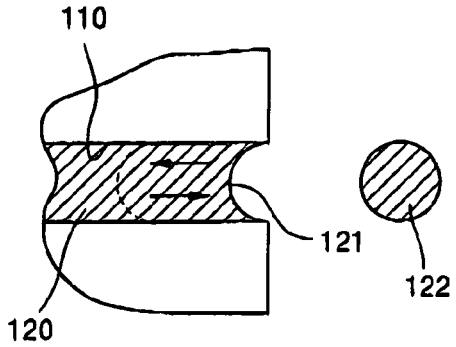
FIGS. 7A and 7B illustrate cross-sectional views for explaining a phenomenon in which a volume of an ink droplet decreases as a driving frequency increases in an ink-jet printhead driven according to the method of FIG. 4.
Figure 7B:
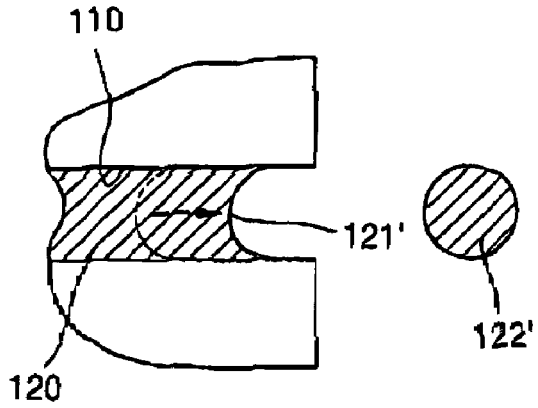

FIGS. 7A and 7B illustrate cross-sectional views for explaining a phenomenon in which a volume of an ink droplet decreases as a driving frequency increases in an ink-jet printhead driven according to the method of FIG. 4.

Referring to FIG. 7A, when the driving frequency is relatively low, even when a droplet 122 having a relatively large volume, e.g., about 30 pl, is ejected, a nozzle 110 is able to be completely refilled with ink 120 after the ejection of the droplet 122 and the meniscus 121 of the ink 120 reaches an end portion of the nozzle 110, and, thus, is returned to an original state thereof. Accordingly, a droplet having a desired volume can be continuously ejected.

However, as shown in FIG. 7B, when the driving frequency is relatively high, e.g., ten (10) kHz or more, the time after a droplet 122' having a relatively large volume, e.g., about 30 pl, is ejected and before the next droplet is ejected is very short. Thus, the nozzle 110 is not able to completely refill with ink 120 and the meniscus 121' does not reach the end portion of the nozzle 110, before the next droplet is ejected. When this occurs, the volume of the ejected droplet 122 disadvantageously decreases, as shown in the graph of FIG. 6.

Accordingly, the present invention additionally provides a driving method by which the volume of the droplet in a high frequency range is not smaller than that in a low frequency range.

Figure 8:
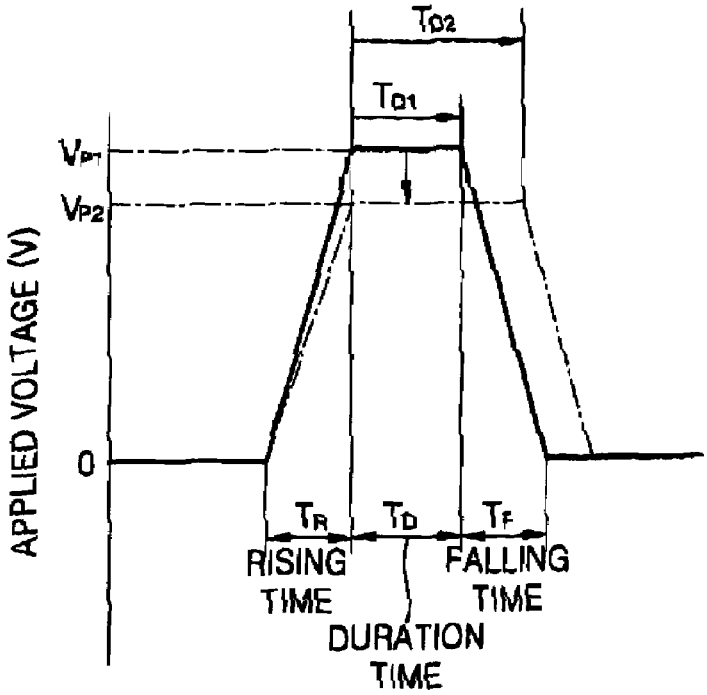
FIG. 8 illustrates a waveform of a driving pulse used in a method of driving an ink-jet printhead according to a second embodiment of the present invention.
Figure 9:
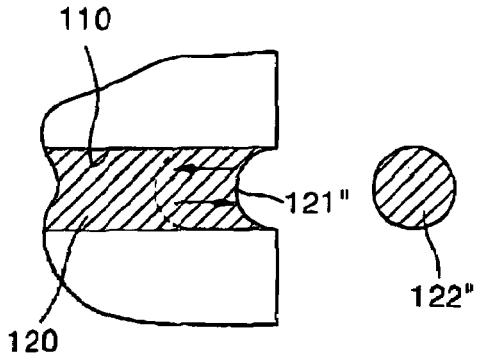
FIG. 9 illustrates a cross-sectional view of a volume of the ink droplet being constantly maintained in the method of FIG. 8, although a driving frequency increases.

FIG. 8 illustrates waveforms of a driving pulse used in a method of driving an ink-jet printhead according to a second embodiment of the present invention. FIG. 9 illustrates a cross-sectional view explaining that, although a driving frequency increases, the volume of the ink droplet is constantly maintained in the method of FIG. 8.

Referring to FIG. 8, in the second embodiment of the present invention, when the rising time $T_R$ of the driving pulse applied to the piezoelectric actuator is constantly maintained, the duration time $T_D$ of the maximum voltage $V_P$ and the maximum voltage $V_P$ may be adjusted together. Then, not only may the volume of the droplet be varied while the ejection speed of the droplet is maintained relatively constant, but also the volume of the droplet in the high frequency range does not decrease as compared to that in the low frequency range due to the adjustment of the maximum voltage $V_P$.

More specifically, when the driving frequency is relatively high, e.g., ten (10) kHz or more, as the duration time $T_D$ of the driving pulse applied to the piezoelectric actuator is increased from $T_{D1}$ to $T_{D2}$, the maximum voltage is reduced from $V_{P1}$ to $V_{P2}$. Then, as shown in FIG. 9, a degree of retreat of the meniscus 121" decreases in the process in which the droplet 122" is returned to the original position after being ejected. Accordingly, since the time for the meniscus 121" of the ink 120 to reach the end portion of the nozzle 110 is reduced, the nozzle 110 may be completely refilled with ink 120 before the next droplet is ejected. That is, since the ejection of the next droplet occurs in the state in which the nozzle 110 is completely refilled with ink 120, even at a high driving frequency, the volume of the droplet 122" is not decreased.

Figure 10:
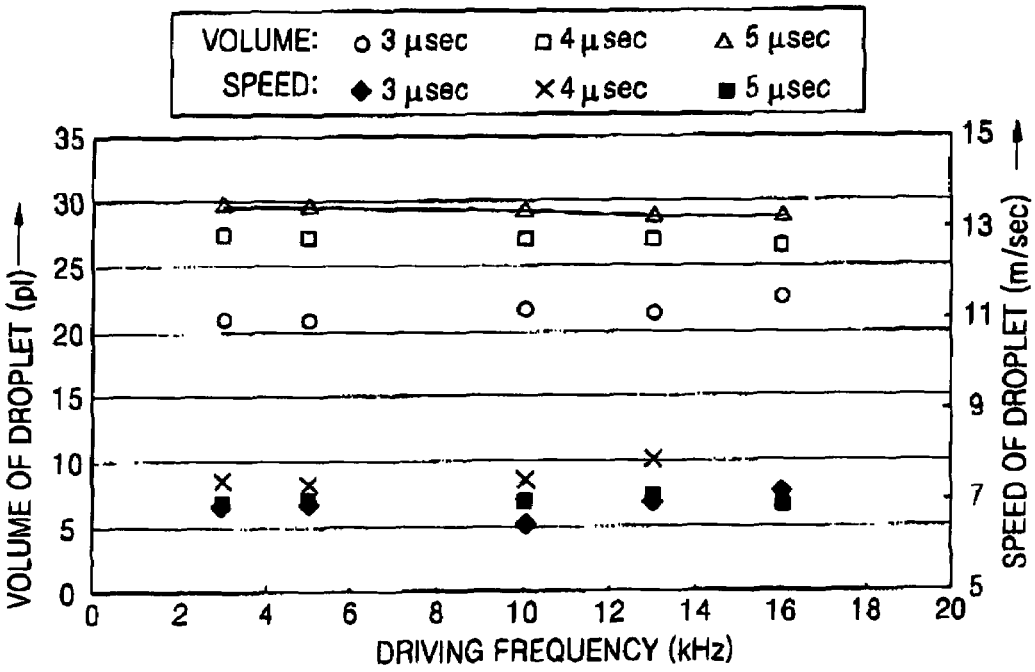
FIG. 10 is a graph showing results of tests on ink droplet ejection performance of a printhead driven according to the method of FIG. 8.

FIG. 10 is a graph showing results of tests on ink droplet ejection performance of a printhead driven according to the method of FIG. 8. The graph of FIG. 10 shows results of a measurement of the volume of the ejected ink droplet and the ejection speed of the ink droplet when the driving frequency is changed, i.e., when the rising time $T_R$ and the falling time $T_F$ Of the driving pulse applied to the piezoelectric actuator are fixed to one (1) μs and the duration time $T_D$ of the maximum voltage $V_P$ is increased from three (3) μs to five (5) μs in increments of one (1) μs. Further, the graph of FIG. 10 shows the result of a test in which the maximum voltage $V_P$ is decreased from 62 V to 58 V.

In the graph of FIG. 10, it may be seen that the results are similar to those of the graph of FIG. 6 in the low driving frequency range. However, when a droplet having a volume greater than 25 pl is ejected, if the maximum voltage $V_P$ is decreased from 62 V to 58 V, it may be seen that the volume of the droplet is maintained almost constant, not only in a low driving frequency range, but also in a high driving frequency range. Thus, the volume of the ink droplet can be effectively controlled by adjusting both duration time $T_D$ and the maximum voltage $V_P$ of the driving pulse at a relatively high driving frequency, e.g., a driving frequency of ten (10) kHz or more.

As described above, in a method of driving an ink-jet printhead according to an embodiment of the present invention, by constantly maintaining the rising time $T_R$ of the driving pulse and adjusting the duration time $T_D$, droplets having various volumes can be ejected and the speed of the ejection of the droplet can be relatively constantly maintained.

In addition, when the duration time and the driving voltage of the driving pulse are adjusted together, the volume of the droplet may be maintained relatively constant even when the driving frequency increases, and the volume of the droplet may be easily changed by adjusting the duration time of the driving pulse in the high frequency area. Thus, since the volume of the droplet for representation of gradation is readily adjusted and the ejection speed of the droplet can be maintained relatively constant, print quality can be improved.

Exemplary embodiments of the present invention have been disclosed herein and, although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A method of driving an ink-jet printhead, the ink-jet printhead having a pressure chamber to be filled with ink, a piezoelectric actuator for varying a volume of the pressure chamber, and a nozzle, through which an ink droplet is ejected, connected to the pressure chamber, the method comprising:

applying a driving pulse to the piezoelectric actuator to change the volume of the pressure chamber, thereby ejecting the ink droplet through the nozzle due to a change in pressure in the pressure chamber caused by the change in volume of the pressure chamber;

changing a volume of the ink droplet ejected through the nozzle by maintaining a rising time of the driving pulse constant and adjusting a duration time of a maximum voltage of the driving pulse; and terminating the duration time of the maximum voltage of the driving pulse before a maximum displacement of the piezoelectric actuator is reached.

2. The method as claimed in claim 1, wherein changing the volume of the ink droplet ejected through the nozzle includes increasing the duration time of the maximum voltage of the driving pulse to increase the volume of the ink droplet ejected through the nozzle.

3. The method as claimed in claim 1, wherein changing the volume of the ink droplet ejected through the nozzle includes varying the duration time of the maximum voltage of the driving pulse within a range of about three (3) μs to about nine (9) μs.

4. The method as claimed in claim 1, further comprising maintaining a falling time of the driving pulse constant.

5. The method as claimed in claim 4, wherein the falling time is about 1 μs.

6. The method as claimed in claim 1, wherein changing the volume of the ink droplet ejected through the nozzle includes varying the volume of the ejected ink droplet from about 20 pl to about 50 pl.

7. The method as claimed in claim 1, wherein changing the volume of the ink droplet ejected through the nozzle includes varying the maximum voltage of the driving pulse in addition to adjusting the duration time of the maximum voltage of the driving pulse.

8. The method as claimed in claim 7, wherein varying the maximum voltage of the driving pulse and adjusting the duration time of the maximum voltage of the driving pulse includes decreasing the maximum voltage of the driving pulse as a driving frequency of the ink-jet printhead increases.

9. The method as claimed in claim 1, wherein the rising time is about 1 μs.

* * * * *